US006007704A

United States Patent [19]

Chapus et al.

[11] Patent Number: 6,007,704

[45] Date of Patent: Dec. 28, 1999

[54] PROCESS FOR THE PRODUCTION OF CATALYTIC CRACKING GASOLINE WITH A LOW SULPHUR CONTENT

[75] Inventors: Thierry Chapus, Paris; Blaise Didillon, Rueil Malmaison; Christian Marcilly, Houilles; Charles Cameron, Paris, all of France

[73] Assignee: Institut Francais du Petrole, Rueil-Malmaison Cedex, France

[21] Appl. No.: 08/936,101

[22] Filed: Sep. 23, 1997

[30] Foreign Application Priority Data

Sep. 24, 1996 [FR] France ..... 96 11691

[51] Int. Cl.[6] ..... C10G 67/04; C10G 67/12; C10G 67/16

[52] U.S. Cl. ..... 208/218; 208/210; 208/211; 208/212; 585/259

[58] Field of Search ..... 208/218, 210, 208/211, 212; 585/259

[56] References Cited

U.S. PATENT DOCUMENTS

| | | | |
|---|---|---|---|
| 2,025,255 | 12/1935 | Taylor et al. | 208/218 |
| 2,270,667 | 1/1942 | Caselli et al. | 208/218 |
| 2,983,669 | 5/1961 | Noll | 208/97 |
| 3,341,448 | 9/1967 | Ford et al. | 208/211 |
| 3,424,673 | 1/1969 | Kirk, Jr. | 208/218 |
| 3,957,625 | 5/1976 | Orkin | 208/211 |
| 4,990,242 | 2/1991 | Louie et al. | 208/218 |
| 5,064,525 | 11/1991 | Frame et al. | 208/193 |
| 5,290,427 | 3/1994 | Fletcher et al. | 208/89 |
| 5,318,690 | 6/1994 | Fletcher et al. | 208/89 |
| 5,364,998 | 11/1994 | Sarrazin et al. | 585/259 |

FOREIGN PATENT DOCUMENTS

| | | |
|---|---|---|
| 0 685 552 | 12/1995 | European Pat. Off. . |
| 0 708 167 | 4/1996 | European Pat. Off. . |
| 2 104 631 | 4/1972 | France . |
| 1 470 487 | 12/1968 | Germany . |
| 1 645 689 | 7/1971 | Germany . |
| 967 879 | 8/1964 | United Kingdom . |
| 1565754 | 4/1980 | United Kingdom . |

*Primary Examiner*—Walter D. Griffin
*Attorney, Agent, or Firm*—Millen, White, Zelano & Branigan, P.C.

[57] ABSTRACT

Catalytic cracking gaseolines are treated by: (a) fractionating the raw gasoline cut into two cuts; (b) optional selective diene hydrodenation of the light cut, then mild hydrotreatment and stripping; (c) sweetening the light cut which is conducted before the mild hydrotreatment step by contact with a supported catalyst containing 0.1–1% by weight of palladium, or after the mild hydrotreatment step and which is then an extractive sweetening step, or with a catalyst having an alkaline base optionally incorporated and also an oxidizing agent. The heavy gaseoline fraction is optionally desilphurized in a hydrotreatment unit. The desulpurized and sweetened light gaesoline can be added to the gasoline pool either directly or mixed with the desulphurized heavy gaseoline cut.

16 Claims, 1 Drawing Sheet

PROCESS FOR THE PRODUCTION OF CATALYTIC CRACKING GASOLINE WITH A LOW SULPHUR CONTENT

FIELD OF THE INVENTION

The invention concerns a process and apparatus for the production of catalytic cracking gasolines with a low sulphur content.

BACKGROUND OF THE INVENTION

The production of reformulated gasoline satisfying new environmental regulations requires, in particular, a reduction in the concentration of olefins and/or aromatics (especially benzene), also sulphur (including mercaptans).

Catalytic cracking gasolines have high olefin contents, and the sulphur present in the gasoline pool is about 90% attributable to FCC gasoline.

Hydrotreatment of the feed sent for catalytic cracking can result in gasolines which typically contain 100 ppm of sulphur. Units for hydrotreating FCC feeds operate, however, under severe temperature and pressure conditions, which necessitates high investment.

Hydrotreatment of catalytic cracking gasolines can reduce both the sulphur content and the olefin content in the cut. However, this has the major disadvantage of causing a very large barrel octane drop in the cut, because of saturation of the olefins.

FCC gasoline hydrotreating processes have already been proposed. As an example, United States patent U.S. Pat. No. 5,290,427 describes a process consisting of fractionating the gasoline, desulphurizing the fractions and converting the gasoline fraction over a ZSM-5 zeolite.

U.S. Pat. No. 5,318,690 proposes a process including fractionation of the gasoline, sweetening the light fraction, hydrodesulphurizing the heavy fraction, then converting it over ZSM-5 and re-desulphurizing under mild conditions. That technique is based on separating the raw gasoline to obtain a light fraction which is practically free of sulphur-containing compounds other than mercaptans, so that that fraction can be treated by sweetening alone to remove the mercaptans. In this fashion, the heavy fraction contains a relatively large quantity of olefins which are partially saturated during hydrotreatment. In order to prevent this octane number drop, that patent recommends cracking over ZSM-5 to produce olefins, but this is to the detriment of the yield. Further, the olefins can be reconstituted in the presence of $H_2S$ to form mercaptans, which has the disadvantage of requiring additional sweetening or a desulphurizing step.

In a further prior art method used by the refiner to treat the sulphur problem in gasolines, the fraction with a boiling point of at least 180° C., which contains most of the sulphur-containing compounds other than mercaptans, is separated. This fraction is then downrated with LCO (light cycle oil) and is generally not upgraded, or it is used as a feed diluent.

SUMMARY OF THE INVENTION

The have developed a process for the production of gasolines with a low sulphur content from catalytic cracking, which can upgrade the whole of the gasoline cut, and reduce the sulphur content of the gasoline cut to very low levels, without dropping the gasoline yield, and minimise the octane drop.

More precisely in the process of the invention, the raw gasoline is fractionated into at least one light cut with a boiling point of 210° C. or less containing the major portion of the olefins and mercaptans, and at least one heavy fraction. The light cut undergoes mild hydrotreatment in the presence of hydrogen with a catalyst containing at least one group VIII metal and/or at least one group VI metal, at a temperature of 160–380° C., at a pressure of 5–50 bar, and the effluent obtained is stripped to eliminate $H_2S$. The light fraction undergoes sweetening which is carried out using at least one of the following methods:

- before the mild hydrotreatment step, treating the light cut in the presence of hydrogen using a catalyst containing 0.1–1% of palladium deposited on a support, at a temperature of 50–250° C., at a pressure of 4–50 bar;
- extractive sweetening of the effluent obtained after mild hydrotreatment and stripping;
- sweetening the effluent obtained after mild hydrotreatment and stripping, using an oxidizing agent, a catalyst and an alkaline base which may or may not be incorporated into the catalyst.

The feed is a catalytic cracking gasoline, in which the boiling point range typically extends from $C_5$ to 220° C. The end point of the gasoline cut depends, of course, on the refinery and on market requirements, but are generally within the limits indicated above.

The sulphur content of these gasoline cuts produced by catalytic cracking (FCC) depends on the sulphur content of the feed which undergoes FCC, also the end point of the cut. Light fractions naturally have a lower sulphur content than the heavier fractions. In general, the sulphur content of the whole of the FCC gasoline cut is over 100 ppm by weight and usually over 500 ppm by weight. For gasolines with end points of more than 200° C., the sulphur contents are often over 1000 ppm by weight, and in some cases can reach values of the order of 4000 to 5000 ppm by weight.

In accordance with the invention, the raw gasoline from catalytic cracking is fractionated into at least one light cut and at least one heavy cut.

The light cut has an end point of 210° C. or less, advantageously 180° C. or less, preferably 160° C. or less and more preferably 145° C. or less.

The light fraction of the gasoline cut contains relatively few sulphur-containing compounds, the majority of which are present in the form of mercaptans, while the sulphur-containing compounds in the heavier fractions are present in the form of substituted or unsubstituted thiophenes, or heterocyclic compounds such as benzothiophene which, in contrast to mercaptans, cannot be eliminated by extractive processes. These sulphur-containing compounds are consequently eliminated by hydrotreatment. The light fraction is relatively rich in olefins, and the sulphur is essentially present in the form of mercaptans, while the heaviest cut is relatively depleted in olefins and is characterized by much higher sulphur contents.

More generally, and in contrast to the prior art, the cut point is selected so as to maximise the olefin content in the light cut.

The catalytic cracking (FCC) gasoline cut is thus fractionated into at least two fractions, which then undergo different desulphurization treatments. The light fraction undergoes a desulphurization treatment constituted by mild hydrogenation, optionally preceded by selective hydrogenation of the diolefins. The hydrogenation conditions are selected so as to be mild to minimise saturation of high octane number olefins. Desulphurization is thus not complete but it can eliminate practically all of the sulphur-containing compounds other than the mercaptans so that essentially mercaptans remain in the cut. They are then eliminated by sweetening. This sweetening step can be extractive sweetening or sweetening by fixed bed catalytic oxidation of the mercaptans.

Diene Hydrogenation

Diene hydrogenation is an optional but advantageous step which can eliminate practically all of the dienes present in the light fraction before the mild hydrotreatment step. It is generally carried out in the presence of a catalyst comprising at least one group VIII metal (preferably Pt, Pd or Ni) and a support, at a temperature of 50–250° C. and a pressure of 4–50 bar. This step does not necessarily cause sweetening. It is particularly advantageous to operate under conditions such that at least partial sweetening of the gasoline is obtained, i.e., a reduction in the mercaptan content.

This is advantageously achieved by using a catalyst comprising 0.1% to 1% of palladium deposited on a support operating at a pressure of 4–25 bar, at a temperature of 50–250° C., with a liquid hourly space velocity (LHSV) of 1 to 10 $h^{-1}$.

The catalyst comprises palladium (0.1% to 1% by weight, preferably 0.2% to 0.5% by weight) deposited on an inert support such as alumina, silica, silica-alumina, or a support containing at least 50% of alumina.

It can be associated with a further metal to form a bimetallic catalyst, for example nickel (1–20% by weight, preferably 5–15% by weight) or gold (Au/Pd weight ratio of 0.1 or more and less than 1, preferably in the range 0.2 to 0.8).

The choice of operating conditions is of particular importance. Most generally, it is carried out under pressure in the presence of a quantity of hydrogen which is in slight excess with respect to the stoichiometric value required to hydrogenate the diolefins. The hydrogen and the feed to be treated are injected as an upflow or as a downflow into a reactor which preferably has a fixed catalyst bed. The temperature is most generally in the range 50° C. to 200° C., preferably in the range 80° C. to 200° C., and more preferably in the range 150° C. to 170° C.

The pressure is sufficient to keep more than 80% by weight, preferably more than 95% by weight, of the gasoline to be treated in the liquid phase in the reactor, namely most generally between 4 and 50 bar, preferably above 10 bar. An advantageous pressure is in the range 10–30 bar, preferably in the range 12–25 bar.

Under these conditions, the space velocity is 1–10 $h^{-1}$, preferably in the range 4–10 $h^{-1}$.

The light fraction of the catalytic cracking gasoline cut can contain of the order of 1% by weight of diolefins. After hydrogenation, the diolefin content is reduced to less than 3000 ppm, preferably less than 2500 ppm and more preferably less than 1500 ppm. In some cases it can be less than 500 ppm. The diene content after selective hydrogenation can even be reduced to less than 250 ppm.

In one implementation of the invention, the hydrogenation step is carried out in a catalytic hydrogenation reactor which comprises a catalytic reaction zone traversed by the whole of the feed and the quantity of hydrogen required to carry out the desired reactions.

In a preferred embodiment of the invention, the hydrogenation step is carried out in a catalytic hydrogenation reactor which is arranged in a particular fashion, namely in two catalytic zones, the first being traversed by the liquid feed (and a quantity of hydrogen which is smaller than the required stoichiometry for converting all of the diolefins to mono-olefins), the second receiving the liquid feed from the first zone (and the rest of the hydrogen, i.e., a quantity of hydrogen sufficient to convert the remaining diolefins to mono-olefins and to isomerise at least a portion of the primary and secondary olefins to tertiary olefins), for example injected via a lateral line and dispersed using a suitable diffuser.

The proportion (by volume) of the first zone is at most 75% of the sum of the two zones, preferably 15% to 30%.

A further advantageous implementation comprises hydrogenation of dienes using a catalyst other than Pd, mild hydrotreatment and final oxidizing sweetening.

Mild Hydrotreatment

Mild hydrodesulphuration of the light fraction of the FCC gasoline cut is intended to convert sulphur-containing compounds in the cut other than mercaptans to $H_2S$, using a conventional hydrotreatment catalyst under mild temperature and pressure conditions, to obtain an effluent containing only mercaptans as the sulphur-containing compounds. The cut produced has the same distillation range, and an octane number which is slightly lower due to inevitable partial saturation of the olefins.

The hydrotreatment reactor conditions must be adjusted to attain the desired level of desulphurization, in particular to minimise the octane loss resulting from saturation of the olefins. In general, at most 90% of the olefins (the diolefins being completely or practically completely hydrogenated), and preferably at most 80–85% of the olefins, are converted.

The temperature of the mild hydrotreatment step is generally in the range 160° C. to 380° C., preferably in the range 180° C. to 360° C., and more preferably in the range 180° C. to 320° C. Low to moderate pressures are generally sufficient, in the range 5 to 50 bar, preferably in the range 10 to 45 bar, and more preferably in the range 10 to 30 bar. The LHSV is in the range 0.5 to 10 $h^{-1}$, preferably in the range 1 to 6 $h^{-1}$.

The catalyst(s) used in the mild hydrotreatment reactor is a conventional hydrodesulphuration catalyst, comprising at least one group VI metal and/or at least one group VIII metal, on a suitable support. The group VI metal is generally molybdenum or tungsten, and the group VIII metal is generally nickel or cobalt. Combinations such as Ni—Mo or Co—Mo are typical. The catalyst support is normally a porous solid such as an alumina, a silica-alumina or other porous solids such as magnesia, silica or $TiO_2$, used alone or mixed with alumina or silica-alumina.

Sweetening

The lightest fraction of the gasoline cut then undergoes non-hydrogenating desulphurization to eliminate the remaining sulphur-containing compounds remaining in the form of mercaptans.

This process may be an extractive sweetening process using caustic soda or sodium or potassium cresylate. Extractive processes are sufficient as the cut which is treated does not contain high molecular weight mercaptans.

Sweetening can also be carried out by catalytic oxidation of mercaptans to disulphides This catalytic oxidation can be carried out by a simple soda wash, i.e., by mixing the gasoline to be treated with an aqueous solution of an alkaline base such as sodium hydroxide, to which a catalyst based on a metal chelate is added, in the presence of an oxidizing agent.

When the mercaptan content in the gasoline is high, a fixed bed of supported catalyst is preferably used for contact, in the presence of an alkaline base and an oxidizing agent. In a first variation, the alkaline base is not incorporated into the catalyst. It is normally an aqueous sodium hydroxide solution; it is introduced into the reaction medium either continuously or intermittently, to maintain the alkalinity and the aqueous phase necessary for the oxidation reaction. The oxidizing agent, generally air, is advantageously mixed with the gasoline cut to be sweetened. The metal chelate used as the catalyst is generally a metal phthalocyanine such as cobalt phthalocyanine. The reaction takes place at a pressure which is in the range 1 to 30 bar, at a temperature which is in the range 20° C. to 100° C., preferably 20° C. to 80° C. The exhausted sodium hydroxide solution is renewed because of impurities from the feed and because of the variation in the concentration of the base which reduces as water is added by the feed and the mercaptans are transformed into disulphides.

In a second, preferred, variation, the alkaline base is incorporated into the catalyst by introducing an alkaline ion into the mixed oxide structure constituted essentially by combined aluminium and silicon oxides.

Alkali metal aluminosilicates are advantageously used, more particularly those of sodium and potassium, characterized by an Si/Al atomic ratio in the structure which is 5 or less (i.e., an $SiO_2/Al_2O_3$ molar ratio which is 10 or less) and which are intimately associated with activated charcoal and a metal chelate and having optimum catalytic performances for sweetening when the degree of hydration of the catalyst is in the range 0.1% to 40%, preferably in the range 1% to 25% by weight thereof. In addition to superior catalytic performances, these alkaline aluminosilicates have the advantage of a very low solubility in aqueous media, allowing their prolonged use in the hydrated state for the treatment of petroleum cuts to which a little water is regularly added or, optionally, an alkaline solution.

This sweetening step (preferably carried out in a fixed bed) for the light gasoline fraction containing mercaptans can thus be defined as comprising contact of the (stabilized) gasoline to be treated with a porous catalyst under oxidation conditions. Preferably, in accordance with EP-A-0 638 628, it comprises 10% to 98%, preferably 50% to 95% by weight, of at least one solid mineral phase constituted by an alkaline aluminosilicate having an Si/Al atomic ratio of 5 or less, preferably 3 or less, 1% to 60% of activated charcoal, 0.02% to 2% by weight of at least one metal chelate and 0 to 20% by weight of at least one mineral or organic binder. This porous catalyst has a basicity, determined in accordance with American standard ASTM 2896, of more than 20 milligrams of potassium per gram and a total BET surface area of more than 10 $m^2/g$, and contains a permanent aqueous phase in its porosity which represents 0.1% to 40%, preferably 1% to 25%, by weight of the dry catalyst.

A large number of basic mineral aluminosilicate type phases (principally sodium and/or potassium) which are particularly suitable can be cited:

When the alkali is mainly potassium:

- kaliophilite: $K_2O$, $Al_2O_3$, $SiO_2$ (1.8<<2.4);
- a feldspathoid known as leucite: $K_2O$, $Al_2O_3$, $SiO_2$ (3.5<<4.5)
- zeolites:
  - philipsite: (K, Na)O, $Al_2O_3$, $SiO_2$ (3.0<<5.0);
  - erionite or offretite: (K, Na, Mg, Ca)O, $Al_2O_3$, $SiO_2$ (4<<8);
  - mazzite or omega zeolite: (K, Na, Mg, Ca)O, $Al_2O_3$, $SiO_2$ (4<<8);
  - L zeolite: (K, Na)O, $Al_2O_3$, $SiO_2$ (5<<8).

when the alkali is sodium:

- amorphous sodium aluminosilicates with a crystalline organisation which cannot be detected by X ray diffraction and in which the Si/Al atomic ratio is 5 or less, preferably less than 3;
- sodalite $Na_2O$, $Al_2O_3$, $SiO_2$ (1.8<<2.4); sodalite can contain different alkaline salts or ions in its structure, such as $Cl^-$, $Br^-$, $ClO_3^-$, $BrO_3^-$, $IO_3^-$, $NO_3^-$, $OH^-$, $CO_3^-$, $SO_3^-$, $CrO_4^-$, $MoO_4^-$, $PO_4^-$, etc. . . . , in the form of alkaline salts, principally of sodium. These different varieties are suitable for use in the present invention. Preferred varieties for use in the present invention are those containing the $OH^-$ ion in the form of NaOH and the $S^-$ ion in the form of $Na_2S$;
- nepheline $Na_2O$, $Al_2O_3$, $SiO_2$ (1.8<<2.4);
- analcime, natrolite, mesolite, thomsonite, clinoptilolite, stilbite, Na-P1 zeolite, dachiardite, chabasite, gmelinite, cancrinite, faujasite comprising X and Y synthetic zeolites, and A zeolite type tectosilicates.

The alkaline aluminosilicate is preferably obtained by reaction of at least one clay (kaolinite, halloysite, montmorillonite, etc. . . . ) in an aqueous medium with at least one compound (hydroxide, carbonate, acetate, nitrate, etc. . . . ) of at least one alkali metal, in particular sodium and potassium, the compound preferably being the hydroxide, followed by heat treatment at a temperature between 90° C. and 600° C., preferably between 120° C. and 350° C.

The clay can also be heat treated and ground before being brought into contact with the alkaline solution. Thus kaolinite and all of its thermal transformation products (meta-kaolin, inverse spinel phase, mullite) can be used in the process of the invention.

When the clay is kaolin, kaolinite and/or meta-kaolin constitute the preferred basic chemical reactants.

Regarding the metal chelate, any chelate used in the prior art for this purpose can be deposited on the support, in particular metal phthalocyanines, porphyrines or corrins. Cobalt phthalocyanine and vanadium phthalocyanine are particularly preferred. The metal phthalocyanine is preferably used in the form of a derivative of the latter, with a particular preference for commercially available sulphonates, such as the mono- or disulphonate of cobalt phthalocyanine and mixtures thereof.

The reaction conditions used to carry out this second variation of sweetening is characterized by the absence of an aqueous base, and a higher temperature and hourly space velocity. The conditions used are generally as follows:

- Temperature: 20° C. to 100° C., preferably 20° C. to 80° C.
- Pressure: $10^5$ to $30\times10^5$ Pascal;
- Quantity of oxidizing agent, air: 1 to 3 kg/kg of mercaptans;
- hourly space velocity, VVH (volume of feed per volume of catalyst per hour): 1 to 10 $h^{-1}$ within the context of the process of the invention.

The water content in the alkaline based catalyst used in the oxidizing sweetening step of the present invention can vary during the operation in two opposing directions:

1) If the petroleum cut to be sweetened has been dried, it can gradually entrain and dissolved water present inside the porosity of the catalyst. Under these conditions, the water content of the latter regularly reduces and can thus drop below a limiting value of 0.1% by weight.
2) In contrast, if the petroleum cut to be sweetened is saturated with water and because the sweetening reaction is accompanied by the production of one molecule of water per molecule of disulphide formed, the water content of the catalyst can increase and reach values of more than 25% and in particular 40% by weight, which are values at which the catalyst performance deteriorates.

In the first case, water can be added to the petroleum cut upstream of the catalyst in sufficient quantities either continuously or discontinuously to maintain the desired internal degree of hydration, i.e., the water content of the support is kept between 0.1% and 40% by weight of the support, preferably between 1% and 25%.

In the second case, the temperature of the feed is fixed at a sufficient value, less than 80° C., to dissolve the water of reaction resulting from the transformation of the mercaptans to disulphides. The temperature of the feed is thus selected so as to maintain the water content of the support between 0.1% and 40% by weight of the support, preferably between 1% and 25% thereof.

This interval of predetermined water contents of the supports will depend, of course, on the nature of the catalytic support used during the sweetening reaction. We have established, in accordance with FR-A-2 651 791, that while a number of catalytic supports are capable of being used without aqueous sodium hydroxide (or without base), their activity only manifests itself when their water content (also known as the degree of hydration of the support) is kept within a relatively narrow range of values, which varies depending on the supports, but is apparently linked to the silicate content of the support and to the structure of its pores.

We have established that, particularly advantageously, this sweetening step can be eliminated when the light cut has been selectively hydrogenated to eliminate dienes and when at the same time sweetening occurs. The sweetening yield can be such that the final sweetening step using an oxidizing agent is no longer necessary. This is the case when using a palladium based catalyst as described above.

The presence of this step using a palladium catalyst means that the sweetening step can be modified, for example by increasing the hourly space velocity, resulting in increased productivity, or by reducing the quantity of catalyst, resulting in reduced investment.

When the final sweetening step is used, a selective diene hydrogenation step can be used which is not a sweetening step.

Hydrodesulphuration of the Heavy Fraction

The heaviest FCC gasoline fraction is hydrodesulphurized using the same procedure as that used for the light fraction. The catalyst also contains at least one group VIII metal and/or group VI metal, deposited on a support. Only the operating conditions are adjusted, to obtain the desired level of desulphurization for this cut which is richer in sulphur. The temperature is generally in the range 200° C. to 400° C., preferably in the range 220° C. to 400° C. The operating pressures are generally in the range 20 to 80 bar, preferably in the range 30 to 50 bar. The effluent obtained is stripped to eliminate $H_2S$ and is sent to the gasoline pool.

The invention also concerns an apparatus for carrying out the process of the invention.

DETAILED DESCRIPTION OF THE DRAWINGS

Figure 1:
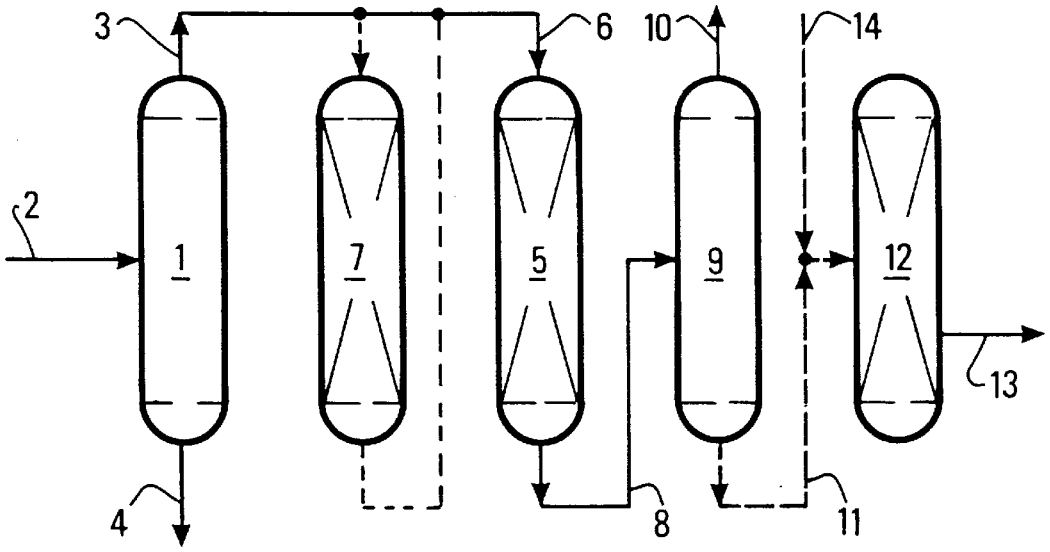
FIGS. 1 and 2 are schematic flowsheets of the apparatus of the invention.

The apparatus comprises:

- a fractionation column (1) provided with a line (2) for introducing raw gasoline from a catalytic cracking step and comprising at least two lines, one (3) in the upper portion of the column for taking off a light cut, and the other (4) in the lower portion of the column for taking off the heavy cut;
- a zone (5) for hydrotreatment in the presence of hydrogen, comprising a catalytic bed, an inlet line (6) for the light gasoline cut to be treated, said line being connected either to the fractionation column (1), or to the zone (7) for treatment over a palladium catalyst, said hydrotreatment zone also comprising an outlet line (8) for hydrotreated effluent;
- a stripping zone (9) comprising a line for introducing light hydrotreated gasoline, a line (10) for evacuating $H_2S$ and an outlet line (11) for stripped light gasoline;

and said apparatus also comprising at least one of the following sweetening zones:

- a sweetening zone (12) located after the stripping zone, comprising a line for introducing stripped light gasoline and a line (14) for supplying an oxidizing agent to said zone;
- a treatment zone (7) located after the hydrotreatment zone and comprising a line (3) for introducing the light gasoline cut from the fractionation column, an outlet line for the treated light gasoline cut, said zone also comprising at least one catalyst bed containing 0.1–1% of palladium deposited on a support, and said apparatus further comprising a line (13) for taking the stripped and sweetened light gasoline out of the apparatus, and connected either to the zone (9) or to the zone (12) if present.

In one variation, the sweetening zone is located after the stripping step and the apparatus further comprises a selective diene hydrogenation zone located between the fractionation column and the mild hydrotreatment zone, said hydrogenation zone comprising a line for introducing the light cut and an outlet line for the dedienized light cut.

In preferred mode, the apparatus also comprises a heavy fraction hydrotreatment zone (15), provided with a line (4) for introducing a heavy cut from column (1), an outlet line (16) for the hydrotreated cut and a line (17) supplying hydrogen to the feed or to the zone, said zone being followed by a stripping column (18) provided with a line for introducing hydrotreated cut, an outlet line (19) for $H_2S$ and an outlet line (20) for hydrotreated cut. The cuts leaving via lines (20) and (13) can be sent to the gasoline store via a line (21).

Figure 2:
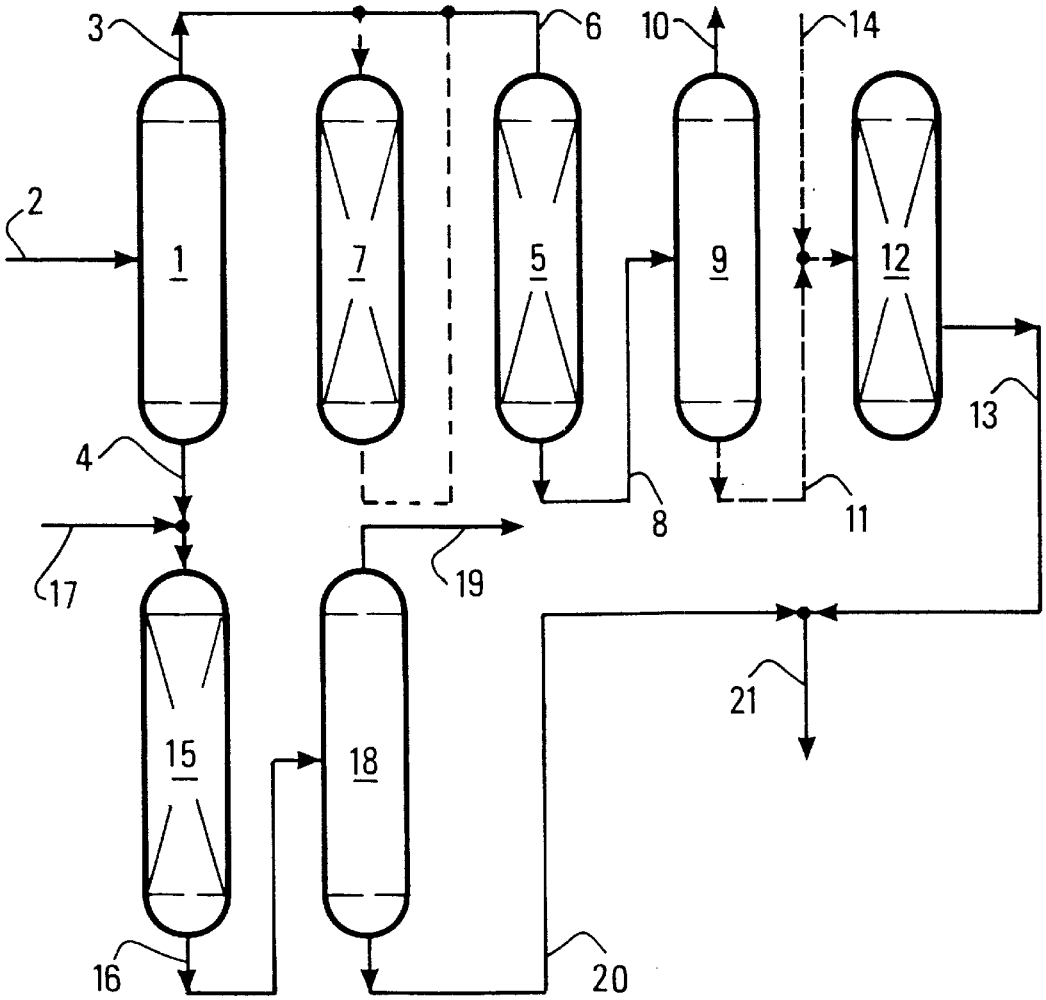

The reference numerals refer to FIGS. 1 and 2. FIG. 1 shows an apparatus for treating a light cut, with the sweetening zones shown as dotted lines. Three implementations can be used:

- first mode, with a sweetening zone (7) but without zone (12);
- second mode, with zone (12) but without zone (7);
- and a third mode, with zones (12) and (7).

The heavy cut treatment has been added in FIG. 2.

The hydrogen supply lines have not been shown as they would complicate the diagrams, but clearly when zone (7) or a diene hydrogenation zone is present, there is a line supplying hydrogen to the light cut or directly to the reactor. In the absence of such zones, the line opens directly into the hydrotreatment zone or into the light cut.

EXAMPLE 1

The following example illustrates the process when the raw gasoline is fractionated to a light $C_5$ cut of less than 180° C., and a heavier fraction, 180–220° C. Table 1 shows the characteristics of these different cuts.

TABLE 1

Characteristics of different FCC gasoline cuts

| Cut | Total gasoline ($C_5$-220° C.) | Light fraction ($C_5$-180° C.) | Heavy fraction (180–220° C.) |
|---|---|---|---|
| (weight %) | (100) | (70) | (30) |
| Olefin content (wt %) | 44.0 | 56.4 | 10.0 |
| Aromatics content (wt %) | 23.0 | 4.6 | 66.0 |
| Bromine number | 68 | 90 | 16 |
| Total sulphur (ppm wt) | 200 | 154 | 307 |
| Mercaptan sulphur (ppm wt) | 106 | 74 | 0 |
| RON | 92.0 | 92.5 | 90.8 |
| MON | 80.0 | 80.7 | 78.4 |
| (RON + MON)/2 | 86.0 | 86.6 | 84.6 |

The light cut from the FCC gasoline was rich in olefins and contained almost all of the mercaptans. The heavier fraction, richer in sulphur, contained sulphur-containing compounds essentially in the form of thiophenic derivatives.

Table 2 below shows the operating conditions used for hydrotreatment of the heavy fraction, also the characteristics of the desulphurized heavy fraction.

The catalyst used was a CoMo on an alumina support (HR306C sold by Procatalyse).

TABLE 2

Characteristics of hydrodesulphuration of heavy gasoline. Characteristics of desulphurized heavy gasoline

| | Feed before desulphurizing | Desulphurized heavy gasoline |
|---|---|---|
| Characteristics of heavy gasoline | | |
| Distillation range (° C.) | 180–220 | 180–220 |
| Olefin content (wt %) | 10.0 | 2.6 |
| Broniine number | 16 | 4.2 |
| Total sulphur (ppm wt) | 307 | 10 |
| Mercaptan sulphur (ppm wt) | 0 | o |
| RON | 90.8 | 88.8 |
| MON | 78.4 | 77.0 |
| Operating conditions | | |
| Temperature (° C.) | 300 | |
| Pressure (bar) | 30 | |

Table 3 below shows the characteristics of the desulphurized then sweetened light gasoline. During the mild hydrotreatment step, the temperature was 280° C., the pressure was 20 bar, the LHV was 8 $h^{-1}$ and the catalyst was LD 145, based on NiMo sold by Procatalyse, followed by a CoMo catalyst (HR306C sold by Procatalyse).

TABLE 3

Characteristics of initial light gasoline, after mild hydrotreatment then after sweetening.

| Characteristics of light gasoline | Light gasoline feed | Desulphurized light gasoline | Desulphurized and sweetened light gasoline |
|---|---|---|---|
| Distillation range (° C.) | C5-180 | C5-180 | C5-180 |
| MAV | 4 | | |
| Olefin content (wt %) | 56.4 | 30.0 | 30.0 |
| Bromine number | 90 | 47 | 47 |
| Total sulphur (ppm wt) | 154 | 19 | 19 |
| Mercaptan sulphur (ppm wt) | 74 | 19 | <5 |
| RON | 92.5 | 86.5 | 86.5 |
| MON | 80.7 | 77.0 | 77.0 |

Sweetening was carried out using a catalyst comprising sodalite (alkaline aluminosilicate) and 20% of activated charcoal, impregnated with an oxidizing agent such as sulphonated cobalt phthalocyanine (PeCo impregnation: 60 kg ($m^3$ of catalyst) prepared as described in European patent EP-A-0 638 628).

The process and apparatus of the invention can obtain FCC gasolines containing less than 50 ppm of sulphur, which respond negatively to the doctor test and which have a barrel octane number drop (RON+MON)/2 of less than 8 points with respect to the same raw gasoline FCC cut before treatment, preferably 6 points or less.

The preceding examples can be repeated with similar success by substituting the generically or specifically described reactants and/or operating conditions of this invention for those used in the preceding examples.

The entire disclosure of all applications, patents and publications, cited above and below, and of corresponding French application 96/11691, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

We claim:

1. A process for the production of gasoline with a low sulphur content from catalytic cracking raw gasoline containing olefins, mercaptans and sulphur-containing compounds other than mercaptans, comprising:

(1) fractionating the raw gasoline into at least one light cut with a boiling point of 210° C. or less containing the major portion of the olefins and mercaptans, and at least one heavy fraction;

(2) subjecting the light cut to mild hydrotreatment in the presence of hydrogen with a catalyst containing at least one group VIII metal and/or at least one group VI metal, at a temperature of 160–380° C., at a pressure of 5–50 bar to convert said sulfur compounds other than mercaptans to $H_2S$, and stripping the resultant effluent to eliminate $H_2S$;

(3) subjecting the light cut to sweetening to remove or convert the mercaptans by at least one of the following methods:

before the mild hydrotreatmnent step, treating the light cut in the presence of hydrogen using a catalyst containing 0.1–1% by weight of palladium deposited on a support, at a temperature of 50–250° C., at a pressure of 4–50 bar;

extractive sweetening of the effluent obtained after mild hydrotreatment and stripping; and sweetening the effluent obtained, after mild hydrotreatment and stripping, with an oxidizing agent, a catalyst land an alkaline base which is optionally incorporated into the catalyst, said process being conducted so as to substantially maintain or increase the content of mono olefins in the resultant light cut.

2. A process according to claim 1, in which the heavy fraction undergoes hydrotreatment in the presence of hydrogen with a catalyst containing at least one group VI metal and/or at least one group VIII metal, at a temperature of 200–420° C., at a pressure of 20–80 bar, and the effluent obtained is stripped to eliminate $H_2S$.

3. A process according to claim 2, in which, before the mild hydr treatment step, the light cut undergoes selective diene hydrogenation and the resultant hydrotreated light cut is stripped and undergoes sweetening.

4. A process according to claim 3, comprising conducting the selective diene hydrogenation in the presence of hydrogen and with a catalyst containing 0.1–1% by weight of palladium and 1–20% by weight of nickel.

5. A process according to claim 3, comprising conducting the selective diene hydrogenation with a catalyst containing 0.1–1% by weight of palladium and gold, in an Au/Pd weight ratio of at least 0.1 and less than 1.

6. A process according to claim 3, comprising employing the extractive sweetening step or the sweetening step using an oxidizing agent at 20–100° C. at a pressure of 1–30 bar.

7. A process according to claim 1, in which the light cut has an end point of 180° C. or less.

8. A process according to claim 1, in which the light cut has an end point of 160° C. or less.

9. A process according to claim 1, in which the light cut has an end point of 145° C. or less.

10. A process according to claim 1, in which, before the mild hydrotreatment step, the light cut undergoes selective diene hydrogenation and the resultant hydrotreated light cut is stripped and undergoes sweetening.

11. A process according to claim 10, comprising conducting the selective diene hydrogenation in the presence of hydrogen and with a catalyst containing 0.1–1% by weight of palladium and 1–20% by weight of nickel.

12. A process according to claim 10, comprising conducting the selective diene hydrogenation with a catalyst containing 0.1–1% by weight of palladium and gold, in an Au/Pd weight ratio of at least 0.1 and less than 1.

13. A process according to claim 1, comprising employing the extractive sweetening step or the sweetening step using an oxidizing agent at 20–100° C. at a pressure of 1–30 bar.

14. A process according to claim 1, wherein said sweetening of said light cut is conducted before the mild hydrotreatment step by treating the light cut in the presence of hydrogen using a catalyst containing 0.1–1% by weight of palladium deposited on a support, at a temperature of 50–250° C., at a pressure of 4–50 bar.

15. A process according to claim 1, wherein said sweetening of said light cut is conducted by extractive sweetening of the effluent obtained after mild hydrotreatment and stripping.

16. A process according to claim 1, wherein said sweetening of said light cut is conducted with an oxidizing agent, a catalyst and an alkaline base which is optionally incorporated into the catalyst.

* * * * *